US005834414A

United States Patent [19]

Sowle et al.

[11] Patent Number: 5,834,414

[45] Date of Patent: Nov. 10, 1998

[54] DETERGENT COMPOSITION HAVING IMPROVED CHLORINE STABILITY CHARACTERISTICS, NOVEL CHLORINE CONTAINING PRODUCT FORMAT AND METHOD OF MAKING CHLORINE STABLE COMPOSITION

[75] Inventors: Eddie D. Sowle, Jamestown; Darryl C. Bowling, Greensboro, both of N.C.

[73] Assignee: Ecolab Inc., St. Paul, Minn.

[21] Appl. No.: 733,272

[22] Filed: Oct. 17, 1996

[51] Int. Cl.[6] ..... C11D 7/56

[52] U.S. Cl. ..... 510/379; 252/186.35; 252/186.36; 510/302; 510/307; 510/349; 510/441

[58] Field of Search ..... 510/302, 307, 510/349, 379, 441; 252/186.36, 186.35

[56] References Cited

U.S. PATENT DOCUMENTS

| | | | |
|---|---|---|---|
| 2,220,099 | 11/1940 | Guenther et al. | 260/505 |
| 2,381,960 | 11/1945 | Johnson | 210/23 |
| 2,477,383 | 7/1949 | Lewis | 252/161 |
| 3,308,067 | 3/1967 | Diehl | 252/161 |
| 3,933,672 | 1/1976 | Bartolotta et al. | 252/116 |
| 3,936,537 | 2/1976 | Baskerville, Jr. et al. | 427/242 |
| 3,953,354 | 4/1976 | Faust | 510/302 |
| 4,078,099 | 3/1978 | Mazzola | 510/302 |
| 4,136,045 | 1/1979 | Gault et al. | 252/135 |
| 4,144,226 | 3/1979 | Crutchfield et al. | 528/231 |
| 4,222,905 | 9/1980 | Cockrell, Jr. | 252/547 |
| 4,228,044 | 10/1980 | Cambre | 252/547 |
| 4,239,659 | 12/1980 | Murphy | 252/524 |
| 4,246,495 | 1/1981 | Pressman | 307/141 |
| 4,279,764 | 7/1981 | Brubaker | 510/302 |
| 4,299,717 | 11/1981 | Cottrell et al. | 252/99 |
| 4,309,299 | 1/1982 | Rapisarda et al. | 252/95 |
| 4,412,934 | 11/1983 | Chung et al. | 252/186.38 |
| 4,483,781 | 11/1984 | Hartman | 252/174.12 |
| 4,526,699 | 7/1985 | Jones et al. | 510/302 |
| 4,601,844 | 7/1986 | Cilley | 252/95 |
| 4,634,551 | 1/1987 | Burns et al. | 252/102 |
| 4,663,071 | 5/1987 | Bush et al. | 252/174.19 |
| 4,681,914 | 7/1987 | Olson et al. | 510/302 |
| 4,909,953 | 3/1990 | Sadlowski et al. | 252/99 |
| 4,917,812 | 4/1990 | Cilley | 252/99 |
| 5,205,954 | 4/1993 | Ahmed et al. | 252/99 |
| 5,213,705 | 5/1993 | Olson | 252/95 |
| 5,300,250 | 4/1994 | Morgan et al. | 252/135 |
| 5,407,598 | 4/1995 | Olson et al. | 510/302 |

*Primary Examiner*—Jacqueline V. Howard
*Attorney, Agent, or Firm*—Merchant, Gould, Smith, Edell, Welter & Schmidt, P.A.

[57] ABSTRACT

A novel detergent composition and product form provides for substantial chlorine stability in detergents having substantial organic surfactant concentration. The product format ensures that water contained in the formulation, contact between sensitive organic materials and the chlorine source are structurally isolated preventing undesirable chlorine surfactant interactions and instability. Particulate detergents can be packaged in any arbitrary packaging component that can maintain a dry flowable powder.

42 Claims, 4 Drawing Sheets

DETERGENT COMPOSITION HAVING IMPROVED CHLORINE STABILITY CHARACTERISTICS, NOVEL CHLORINE CONTAINING PRODUCT FORMAT AND METHOD OF MAKING CHLORINE STABLE COMPOSITION

FIELD OF THE INVENTION

The invention relates to a free flowing powder detergent compositions having an organic surfactant component and an encapsulated chlorine source that is stable in storage at temperatures common in production, shipment, storage and use. More particularly, the invention relates to powdered surfactant containing laundry detergents having an encapsulated chlorine source that can clean, sanitize, destain, etc. washing articles using a temperature stable formulation.

BACKGROUND OF THE INVENTION

Many detergents, used in laundry and other applications, contain a halogen source or other stain removing bleach composition in combination with ingredients such as a detergent, builder salts, fillers, corrosion inhibitors, dyes, sequestrants, surfactants, etc. In large part, laundry detergents that have halogen or chlorine bleaching components have been packaged in two part or two package systems wherein the chlorine bleach is formulated with inorganic or materials that cannot be oxidized in a first packet while the sensitive organic or oxidizable materials are separately packaged in a second packet. When used, the packages are opened and combined in a laundry process.

While one packet systems are known, one packet systems commonly contain perborate, or other peroxygen type bleaches that are not as active and are not destructive to organic components and detergent formulations. In formulating one package systems, minimal amounts of organic materials are used when in contact with oxidizing bleaches, in particular, halogen bleaches. While a number of suggestions with respect to the combination of encapsulated halogen bleaches and detergent systems containing substantial proportions of organic materials have been made, no successful one packet material having a significant shelf life stability has been available on the market. In this application, stability typically indicates the retention of substantial (greater than 80%, preferably greater than 90%, most preferably greater than 95%) of the added halogen or chlorine at 120° F. for two months or more. An alternative measure of stability includes retention of substantial amount of halogen or chlorine activity (greater than 80%, preferably greater than 90%, most preferably greater than 95%) of available chlorine at 110° F. for greater than six months.

Sodium carbonate and sodium pyrophosphate have been used in granular detergent compositions (for example, Cottrell et al., U.S. Pat. No. 4,299,717 disclose such compositions). Water softening compositions comprising alkali metal phosphates, hydroxides, carbonates and tetrasodium pyrophosphates are known and are disclosed in Johnson, U.S. Pat. No. 2,381,960. Further, Morgan et al., U.S. Pat. No. 5,300,250, teach granular laundry compositions having improved solubility resulting from admixture of sodium carbonate and a hydrophobic amorphous silicate material. Morgan et al. disclose that problems relating to the solubility sodium carbonate can be improved by careful formulation.

We have found that the problems with respect to chlorine stability is intimately connected with the physical nature of the blended product and the product's composition. A simple blend of an encapsulated chlorine material with a simple admixture or blend of powdered ingredients, containing organic material and free water, permits ready contact between a chlorine source and an oxidizable organic in the presence of free water. Such an intimate mixture provides for a ready reaction between the chlorine and the organic materials. The result of such a reaction is a rapid depletion of chlorine activity and reduction in the concentration of the active organic material attacked by chlorine. We have found that control of free water, and sequestration of oxidizable organic species from the chlorine source in a single packet powder mixture can result in substantially increased stability in one part chlorine containing detergent formulations.

BRIEF DISCUSSION OF THE INVENTION

We have found that problems associated with loss of halogen or chlorine activity in one packet laundry detergents can be substantially remedied if water and oxidizable organic materials are segregated from the halogen source within an inorganic blend in the form of a dried powder. We have found that free water and active organic materials can be absorbed into and held within a free flowing dry particulate. The dry particulate comprises a builder salt internal composition and an external silicate composition. The organic surfactants and the water used in product formulation are absorbed into the internal composition and is covered and segregated from the halogen source by the external silicate composition. This dry particulate can then be dry blended with encapsulated chlorine sources. The dried particulate segregates free water and oxidizable organics from the chlorine source resulting in substantial chlorine stability, retention of active chlorine concentrations and retention of active organic materials. For the purpose of this patent application the term "dried powder" indicates a material that is processed in such a way that water content of the powder is driven from the powder using thermal processing. The term "dried powder" also includes a material in which water becomes closely associated with the inorganic materials. The resulting powder is free flowing contains water and appears to be dry. Such internal water is no longer available for reaction outside the powder. The powder appears to be dried, but segregates the water as water of hydration, absorbed or encapsulated water or some other form of unavailable water. For the purpose of this patent application, we recognize two standards for chlorine stability that have been recognized by Ecolab Inc. and by the art. Chlorine stability can, in one context, can means retention of substantial amount of oxidizing capacity at 120° F. for greater than sixty days. Alternatively, stability can be retention of a substantial amount of chlorine stability at 110° F. for greater than six months. The term "retention of chlorine stability" indicates that at least 80%, preferably 90%, of the active chlorine added to a detergent material is retained over the test period.

BRIEF DISCUSSION OF DRAWINGS

FIGS. 1 through 4 are bar graphs showing the percent of available chlorine remaining in samples maintained for a period from about 0 to about 6 weeks. The samples contain an encapsulated chlorine source (Enforcer RC or ACP) or unencapsulated chlorinated isocyanurate hydrate (CDB).

DETAILED DESCRIPTION OF THE INVENTION

This invention relates to a granular detergent, bleach or additive composition containing admixed sodium carbonate, organic surfactant and an external silicate material. The composition is halogen stable and is soluble in cold or cool water, i.e. the composition readily dissolves/disperses in water at a temperature between about 32° F. (0° C.) and 90° F. (32.2° C.), preferably between about 35° F. (1.6° C.) and 50° F. (10° C. The silicate material also acts as an anti-caking agent and flow aid, which improves physical properties and handling characteristics of the present compositions and increases density.

The granular compositions of the present invention contain admixed sodium carbonate and hydrophobic amorphous silicate material, an encapsulated halogen source and an organic detergent surfactant. These and optional ingredients, and processes for making the compositions and improving the solubility of such compositions, are described in detail hereinafter.

Sodium Carbonate

The compositions of the present invention contain from about 5 to 99.95 wt %, preferably from about 5 to 75 wt %, more preferably from about 7 to 50 wt %, most preferably from about 10 to 40 wt %, of sodium carbonate. Sodium carbonate ($Na_2CO_3$) can easily be obtained commercially. As described above, without the addition of hydrophobic amorphous silicate, such compositions ordinarily have solubility problems under laundering conditions such as when added to the washing machine tub in a pile, particularly when "reverse" order of addition is used and/or cold water is used.

Detergent Surfactant

The compositions of the present invention comprise from 0.1 to 70 wt % of an organic detergent surfactant selected from the group consisting of anionics, nonionics, zwitterionics, cationics, and mixtures thereof. Preferably the surfactant represents from about 0.1 to 50%, most preferably from about 5 to 30%, by weight of the composition and is selected from the group consisting of anionics, nonionics, and mixtures thereof.

Useful anionic surfactants include the water soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_{12}$–$C_{18}$ carbon atoms) such as those produced by reducing the glycerides of tallow or coconut oil; and the sodium and potassium alkylbenzene sulfonates in which the alkyl group contains from about 10 to about 16 carbon atoms, in straight chain or branched chain configuration, e.g., see U.S. Pat. Nos. 2,220,099 and 2,477,383. Especially valuable are linear straight chain alkylbenzene sulfonates in which the average number of carbon atoms in the alkyl group is from about 11 to 14, abbreviated as $C_{11-14}$ LAS. Also, preferred are mixtures of $C_{10-16}$ (preferably $C_{11-13}$) linear alkylbenzene sulfonates and $C_{12-18}$ (preferably $C_{14-16}$) alkyl sulfates, alkyl ether sulfates, alcohol ethoxylate sulfates, etc.

Other anionic surfactants herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms.

Other useful anionic surfactants herein include the water soluble salts of esters of alpha-sulfonated fatty acids containing from about 6 to 20 carbon atoms in the fatty acid group and from about 1 to 10 carbon atoms in the ester group; water soluble salts of 2-acyloxyalkane-1-sulfonic acids containing from about 2 to 9 carbon atoms in the acyl group and from about 9 to about 23 carbon atoms in the alkane moiety; water soluble salts of olefin and paraffin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Water soluble nonionic surfactants are also useful in the instant detergent granules. Such nonionic materials include compounds produced by the condensation of alkylene oxide groups (hydrophilic in nature) with an organic hydrophobic group or compound, which may be aliphatic or alkyl in nature. The length of the polyoxyalkylene group which is condensed with any particular hydrophobic group can be readily adjusted to yield a water soluble compound having the desired degree of balance between hydrophilic and hydrophobic elements.

Included are the water soluble and water dispersible condensation products of aliphatic alcohols containing from 8 to 22 carbon atoms, in either straight chain or branched configuration, with from 3 to 12 moles of ethylene oxide per mole of alcohol. Alkyl phenol ethoxylates should be avoided in the powdered materials of this invention.

Semi-polar nonionic surfactants include water soluble amine oxides containing one alkyl moiety of from about 10 to 18 carbon atoms and two moieties selected from the group of alkyl and hydroxyalkyl moieties of from about 1 to about 3 carbon atoms; water soluble phosphine oxides containing one alkyl moiety of about 10 to 18 carbon atoms and two moieties selected from the group consisting of alkyl groups and hydroxyalkyl groups containing from about 1 to 3 carbon atoms; and water soluble sulfoxides containing one alkyl moiety of from about 10 to 18 carbon atoms and a moiety selected from the group consisting of alkyl and hydroxylalkyl moieties of from about 1 to 3 carbon atoms. Nonionic surfactants are of the formula $R^1(OC_2H_4)_nOH$, wherein $R^1$ is a $C_6$–$C_{16}$ alkyl group and n is from 3 to about 80 can be used. Condensation products of $C_6$–$C_{15}$ alcohols with from about 5 to about 20 moles of ethylene oxide per mole of alcohol, e.g., $C_{12}$–$C_{14}$ alcohol condensed with about 6.5 moles of ethylene oxide per mole of alcohol.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water solubilizing group.

Cationic surfactants can also be included in the present detergent granules. Cationic surfactants comprises a wide variety of compounds characterized by one or more organic hydrophobic groups in the cation and generally by a quaternary nitrogen associated with an acid radical. Pentavalent nitrogen ring compounds are also considered quaternary nitrogen compounds. Halides, methyl sulfate and hydroxide are suitable. Tertiary amines can have characteristics similar to cationic surfactants at washing solution pH values less than about 8.5. A more complete disclosure of these and other cationic surfactants useful herein can be found in U.S. Pat. No. 4,228,044, Cambre, issued Oct. 14, 1980, incorporated herein by reference.

Cationic surfactants are often used in detergent compositions, can provide fabric softening and/or antistatic benefits. Antistatic agents which provide some softening benefit and which are preferred herein are the quaternary ammonium salts described in U.S. Pat. No. 3,936,537, Baskerville, Jr. et al., issued Feb. 3, 1976, which is incorporated herein by reference.

Useful cationic surfactants also include those described in U.S. Pat. No. 4,222,905, Cockrell, issued Sep. 16, 1980, and in U.S. Pat. No. 4,239,659, Murphy, issued Dec. 16, 1980, both incorporated herein by reference.

Silicate Material

The compositions of the invention also contain from about 0.05 to 20 wt %, preferably from about 0.1 to 15 wt %, more preferably from about 0.2 to 12 wt %, most preferably from about 0.3 to 1 wt %, of hydrophobic amorphous silicate material.

The silicate material can comprise an alkali metal silicate, an alumino-silicate material, or an amorphous silicate material. Alkali metal silicates have the formula $MO:SiO_2$ wherein for each part by weight of MO there are about 1 to about 5 moles of $SiO_2$. Preferred compositions are magnesium silicates $MgO:SiO_2$ wherein the ratio is about 1 to about 1.5 to 3.

Also included are fine particle size silicon dioxides, the surfaces of which have been chemically modified to make them predominantly hydrophobic. These materials may be fumed or precipitated. Individual particles have a diameter typically ranging from about 5 to about 100, preferably about 10 to 40, nanometers. However, the precipitated particles usually appear in the form of agglomerates having an average diameter of from about 1 to 100, preferably about 2 to 40, microns.

Hydrophobic amorphous silicate materials useful herein are commercially available under the names Degussa and Sipernat®. These materials are described in Degussa Technical Bulletin Pigments No. 11, issued October 1982, No. 6, issued August 1986, and No. 32, issued April 1980, and a bulletin entitled Precipitated Silicas and Silicates, issued July 1984, all incorporated herein by reference. Examples of suitable materials include Sipernate® D10, D11, D50 and D17, Quso® WR55 and WR83, and Aerosil® R972, R974, R805, and R202. Preferred materials are Aerosil® R972 and Sipernat® D11 and D50, which is particularly preferred.

Other Ingredients

Other ingredients suitable for inclusion in a granular laundry detergent, bleach or additive composition can be added to the present compositions. These include detergency builders, suds boosters or suds suppressers, anti-tarnish and anticorrosion agents, soil suspending agents, soil release agents, germicides, pH adjusting agents, non-builder alkalinity sources, chelating agents, smectite clays, enzymes, enzyme-stabilizing agents and perfumes. Such ingredients are described in U.S. Pat. No. 3,936,537, issued Feb. 3, 1976 to Baskerville, Jr. et al., incorporated herein by reference.

Builders (other than the required sodium carbonate) can be employed to sequester hardness ions and to help adjust the pH of the laundering liquor. Such builders can be employed in concentrations up to about 85% by weight, preferably from about 0.5% to about 50% by weight, most preferably from about 10% to about 30% by weight, of the compositions herein to provide their builder and pH-controlling functions. The builders herein include any of the conventional inorganic and organic water soluble builder salts. Such builders can be, for example, water soluble salts of phosphates including tripolyphosphates, pyrophosphates, orthophosphates, higher polyphosphates, other carbonates, silicates, and organic polycarboxylates. Specific preferred examples of inorganic phosphate builders include sodium and potassium tripolyphosphates and pyrophosphates. Nonphosphorus-containing materials can also be selected for use herein as builders.

Specific examples of nonphosphorus, inorganic detergent builder ingredients include water soluble bicarbonate, and silicate salts. The alkali metal, e.g., sodium and potassium, bicarbonates, and silicates are particularly useful herein.

Water soluble, organic builders are also useful herein. For example, the alkali metal, polycarboxylates are useful in the present compositions. Specific examples of the polycarboxylate builder salts include sodium and potassium salts of ethylenediaminetetraacetic acid, nitrilotriacetic acid, oxydisuccinic acid, mellitic acid, benzene polycarboxylic acid, polyacrylic acid, and polymaleic acid.

Other desirable polycarboxylate builders are the builders set forth in U.S. Pat. No. 3,308,067, Diehl, incorporated herein by reference. Examples of such materials include the water soluble salts of homo- and copolymers of aliphatic carboxylic acids such as maleic acid, itaconic acid, mesaconic acid, fumaric acid, aconitic acid, citraconic acid, and methylenemalonic acid.

Other suitable polymeric polycarboxylates are the polyacetal carboxylates described in U.S. Pat. No. 4,144,226, issued Mar. 13, 1979 to Crutchfield et al., and U.S. Pat. No. 4,246,495, issued Mar. 27, 1979 to Crutchfield et al., both incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization alkaline solution, converted to the corresponding salt, and added to a surfactant.

The compositions herein preferably contain little (e.g., less than 10%, preferably less than 5%, by weight) or no phosphate builder materials. The presence of higher levels of tripolyphosphate improves solubility of the compositions to the point where hydrophobic amorphous silicate provides little or no additional improvements. However, sodium pyrophosphate reduces solubility so that the benefit provided by the hydrophobic amorphous silicate is greater in granular compositions containing pyrophosphate.

Bleaching agents and activators useful herein are also described in U.S. Pat. No. 4,412,934, Chung et al., issued Nov. 1, 1983, U.S. Pat. No. 4,483,781, Hartman, issued Nov. 20, 1984, U.S. Pat. No. 4,634,551, Burns et al., issued Jan. 6, 1987, and U.S. Pat. No. 4,909,953, Sadlowski et al., issued Mar. 20, 1990, all of which are incorporated herein by reference. Chelating agents are also described in U.S. Pat. No. 4,663,071, Kbush et al., from Column 17, line 54 through Column 18, line 68, incorporated herein by reference. Sucd modifiers are also optional ingredients and are described in U.S. Pat. Nos. 3,933,672, issued Jan. 20, 1976 to Bartoletta et al., and 4,136,045, issued Jan. 23, 1979 to Gault et al., both incorporated herein by reference.

Encapsulate Active Oxidant Bleach

The powdered detergent of the invention can comprise an encapsulated source of active halogen oxidant bleach. Preferred encapsulates are disclosed in Olson, U.S. Pat. No. 5,213,705.

The source of active halogen used in the continuous phase of the solid tablet of the invention and used in the core of the encapsulated source of halogen can comprise a halogen releasing substance suitable to liberate oxidizing active halogen species such as free elemental halogen (Cl., Br., $Cl_2$, $Br_2$) or —$OCl^-$ Or —$OBr^{31}$ , under conditions normally used in detergent bleaching cleaning processes of a variety of cleaning targets. Preferably the halogen releasing compound releases chlorine or bromine species. The most preferred halogen species is chlorine. Chlorine releasing compounds include potassium dichloroisocyanurate, sodium dichloroisocyanurate, chlorinated trisodium phosphate, calcium hypochlorite, lithium hypochlorite, monochloramine, dichloramine, [(monotrichloro)-tetra(monopotassium dichloro)]pentaisocyanurate, 1,3-dichloro-5,5-dimethylidantonone, paratoluene sulfodichloro-amide, trichloromelamine, N-chloramine, N-chlorosuccinimide, N,N'-dichloroazodicarbonamide, N-chloroacetyl-urea, chlorinated dicyandiamide, trichlorocyanuric acid, dichloroglycourea, etc. Chlorinated isocyanurate materials including sodium dichloroisocyanurate dihyrate, sodium dichloroisocyanurate, potassium dichloroisocyanurate, etc. are preferred chlorine sources suitable for the continuous solid phase and for the core substance of the encapsulated material. Chlorinated isocyanurates are commercially available from Monsanto or Olin and other vendors.

Encapsulate

Encapsulated chlorine sources of the invention comprise a chlorine source core and at least one encapsulating layer. The encapsulating layer can comprise an inorganic material or an organic material or both in a layer or layers. Further, the core chlorine source can be covered with two, three or more useful organic or inorganic layers. Preferably we have found a two layer coating scheme wherein the core is coated with an inner inorganic layer and an outer organic layer comprising a material (detergent, sequestrant, builder, antiredeposition agent, etc.) useful in washing liquors. For the purposes of this application the term "encapsulating agent", as used herein encompasses solid soluble inorganic compounds used as inert fillers in detergent compositions and soluble inorganic builders used in detergent compositions which contribute to the detergency of the composition and which do not substantially react with a halogen bleach. The external organic phase of the encapsulate can comprise a variety of encapsulating materials that can be selected from small molecule, monomeric or polymeric sources.

Organic Coatings

Small molecule organic compositions that can be used for the external encapsulate layer comprise a large variety of water soluble organic compounds.

A preferred class of small molecule organic encapsulate materials comprise synthetic surfactant compounds. The synthetic surfactant coating must remain sufficiently solid at storage or use temperatures encountered by the encapsulate during storage of the product, for example, temperatures of about 150° to 500° C. and also remain stable at temperatures likely to be encountered during processing of the product. Synthetic surfactants useful in making the encapsulates of the invention include anionic, cationic, nonionic and amphoteric surfactant compositions. Examples of anionic surfactants useful in the encapsulate compositions of the invention are the higher alkyl mononuclear aromatic alkali metal sulfonates such as alkyl benzene sulfonate, xylene sulfonate, alpha olefin sulfonates, primary and secondary alkyl sulfates and others. Alkali metal salts of fatty acids commonly classified as soaps can be used in the definition of an ionic detergent. Examples of such operable soaps include sodium and potassium salts of acyclic monocarboxylic acids having 8 to 12 carbon atoms. A particularly suitable synthetic surfactant for use in a coating composition is sodium alkyl sulfonate having from about 6 to 12 carbon atoms, preferably sodium octyl sulfonate.

Typical nonionic surfactants are commonly materials that contain polymer ethylene oxide, propylene oxide or heteric or block copolymers thereof. Such materials can be made as the condensation products of alkyl phenols having 5–15 carbon atoms any alkyl group, the condensation product with a long chain fatty alcohol or acid, etc. These nonionic surfactants are well known in the art and are available to the skilled artisan. Cationic and amphoteric surfactants are known but are not preferred for these applications. Suitable builders that can be used in the compositions of the invention include weakly acid neutral or alkaline reacting inorganic or organic compounds especially inorganic or organic complex forming substances such as the bicarbonates, carbonates, borates, and silicates of alkali metal or alkali earth metal salts. The alkali metal ortho, meta, pyro and tripolyphosphates are a useful filler/sequestrant material. Another class of suitable builders are the insoluble sodium alumino-silicates. Generally, the shaped solid sources of active bleaching agent of the invention can also contain other elements which impart varying degrees of physical or chemical characteristics. Constituents such as optical binders, deodorizers, antiredeposition agents, dyes, perfumes, dispersing agents, etc. can be added to the shaped solids for known properties.

Soluble Inorganic Coating Agent

Inorganic materials suitable for the coating of the encapsulate of the invention include alkali such as sodium bicarbonate, sodium sesquicarbonate, sodium borate, potassium bicarbonate, potassium sesquicarbonate, potassium borate, phosphates such as diammonium phosphate, monocalcium phosphate, monohydrate, tricalcium phosphate, calcium pyrophosphate, iron pyrophosphate, magnesium phosphate, monopotassium orthophosphate, potassium pyrophosphate, disodium orthophosphate dihydrate, trisodium orthophosphate decahydrate, tetrasodium pyrophosphate, sodium tripolyphosphate, a sodium polyphosphate compound, sodium hexametaphosphate, potassium tripolyphosphate, a potassium polyphosphate compound, neutral or soluble salts such as sodium sulfate, sodium chloride silicates, inorganic sequestering agents and antiredeposition agents and hydrates thereof. Suitable builder compounds that can be used in the coatings of the encapsulate include tetrasodium or tetrapotassium pyrophosphate, pentasodium or pentapotassium tripolyphosphate, sodium or potassium silicates, hydrated or anhydrous borax, sodium or potassium sesquicarbonate, phytates, polyphosphonates and others.

The manufacture of the encapsulated source of oxidizing bleach can be carried out by first providing an initial inorganic protective passivation coating of the core material which can be conveniently applied using fluidized coating apparatus. In making encapsulated materials, the particulates are introduced into the fluidizing chamber of a fluidized bed. The bed of particles to be coated is then suspended with the fluidizing atmosphere. A nozzle is typically introduced into or nearby the fluidized bed through which liquid droplets of coating material are discharged in a diverging pattern coextensive with the upper surface of the bed. Coating solution is applied to the bed at a temperature required for rapid drying of the coating solution on the core particles. Solvent vapors can be removed from the fluidized bed with a blower. Once the particles are fully covered with an initial coating, subsequent coatings can be formed in a similar fashion using known technology. The encapsulated oxidizer of the present invention can contain 20 to 90 wt % of the active oxidizing bleach core and 10 to 80 wt % of a coating. In the instance that dual coatings are used, the encapsulated material can comprise about 20 to 90 wt % of an oxidizing bleach core, about 0.5 to 50 wt% of a first passivating inorganic coating agent and about 5 to 70 wt % of a second synthetic surfactant second coating. More particularly, the single coated oxidizing bleach comprises 30 to 80 wt % of bleach core and about 20 to 70 wt % synthetic surfactant coating, most particularly about 40 to 55 wt % of oxidizing bleach core and 45 to 60 wt % of the first coating. A most preferred embodiment of the double coated oxidizing bleach encapsulate comprises about 30 to 80 wt % of the bleach core, about 5 to 50 wt % of a first inorganic coating agent and about 5 to 50 wt % of a second synthetic surfactant coating. Other materials may be present in the coating layer such as conventional additives used in bleaching or cleaning laundry, dishware, etc. typical examples include well known soil suspending agents, corrosion inhibitors, dyes, perfumes, fillers, optical brighteners, enzymes, germicides, antitarnishing agents, and the like.

EXAMPLE 1

Into a ribbon blender was added about 35.8 parts by weight of sodium carbonate. The blender was energized and into the agitated sodium carbonate was added 19.0 parts of sodium tripolyphosphate. The mixer was operated until the mixture was uniform. Into the sodium carbonate tripoly mixture was added, 6 parts by weight of dodecylbenzene sulfonic acid (BIOSOFT S 126), followed by 4 parts by weight of ammonium lauryl ether sulfate (STEOL CS-460). The mixture was blended in the form of a sticky mass. Into the mass was added about 4.33 parts by weight of a magnesium silicate (an $MgO:SiO_2$ ratio of 1:2.6-Magnisol Flow Plus). The mixture was agitated forming a flowable dry powder. Into the flowable dry powder is added about 4.0 parts of a 60% active aqueous nonionic alcohol ethoxylate ($C_{12-14}$ alcohol, 7 mole EO) surfactant. The mixture was blended until uniform and an additional 4.33 parts of the magnesium silicate was added to the blender. After the mixture became uniform, the mixture was a free flowable dry powder. Into the dry powder was added an optical brightener (Tinopal CBS-X) in an amount of about 0.2 part by weight, followed by an additional 4.33 parts by weight of the magnesium silicate. The blender was operated until the mixture was uniform and into the blended mixture was added an encapsulated dichloroisocyanurate hydrate [Enforcer RC comprises an encapsulated chlorine source using a core of chlorinated dichloroisocyanurate hydrate the encapsulate comprising about 50.26 parts by weight of the chlorinated isocyanurate material. The encapsulate comprises a first layer comprising a mixture of sodium sulfate and sodium tripolyphosphate in amounts of about 23.86 parts and about 7.93. The final layer comprises a mixture of a linear alkane sulfonate and sodium sulfite at a ratio of about 55.5 parts of sulfonate and 0.40 part by weight of sodium sulfite] composition in an amount of about 18 parts by weight. The mixture was agitated until uniform and was packaged.

EXAMPLE 2

Example 1 was repeated exactly except an amorphous silicon dioxide material (Sipernat 50) was used in place of the magnesium silicate material.

EXAMPLE 3

Example 1 was repeated with the following ingredients:

| Ingredient | Parts By Weight |
|---|---|
| Sodium Carbonate | 33 |
| Sodium Tripolyphosphate | 19 |
| Sodium Sulfate | 4.8 |
| Dodecylbenzene Sulfonic Acid | 6.0 |
| Lauryl Ether Ethoxylate Sulfate | 4.0 |
| Amorphous Silicate (Sipernat 50) | 7.0 |
| $C_{12-14}$ Alcohol 7 Mole Ethoxylate-Nonionic | 4.0 |
| Brightener | 0.2 |
| Chlorine Encapsulate | 22.0 |

EXAMPLES 3A–3K

Objective: To determine if powder is stable after 9 week interval.

Made 200 g sample of the powder mixture:

| |
|---|
| 31.8% $Na_2CO_3$ |
| 19.0% STPP |
| 6.0% S-126 |
| 4.0% STEOL 1460 |
| 4.0% NII 412-7 |
| 0.2% Tinopal |
| 13.0% Magnesol |

The powder premix was used to make Examples 3A to 3K by combining the premix with a chlorine source as follows:

Examples 3A to 3E 2.28 Enforcer RC CDB

Encapsulate and 7.72 g. powder premix

Examples 3F to 3J 1.95 g ACP[1] CDB encapsulate 8.05 g powder premix

[1] Encapsulate ACP is identical to Enforcer RC except that the encapsulate contains no sulfonate/sulfite layer.

Examples 3K to 30

1.4 g CDB 8.6 g powder premix

EXAMPLES 4A–4K

Made 200 g sample of the powdered mixture:

33.8% $Na_2CO_3$
19.0% STPP
6.0% S-126
4.0% STEOL 1460
4.0% NII 412-7
0.2% Tinopal
13.0% Magnesol
22.0% did not add
7.0% Sipernat
4.8% $Na_2SO_4$
7.0% Sipernat Examples 4A to 4E
2.28 Enforcer RC
7.72 g. powder
Examples 4F to 4J
1.95 g. ACP
8.00 g. powder
Examples 4K to 40
1.4 g. CDB
8.6 powder
Titration to determine active chlorine.

| Initial | | | 4 Weeks | | 6 Weeks | | |
|---|---|---|---|---|---|---|---|
| 3A | 2.1 ml | 7.45% | 3B | 7.09% | 3C | 2.1 ml | 7.45% |
| 3F | 2.1 ml | 7.45% | 3G | 8.33% | 3H | 2.0 ml | 7.09% |
| 3K | 2.3 ml | 8.15% | 3L | 7.09% | 3M | 1.8 ml | 6.38% |
| 4A | 2.0 ml | 7.09% | 4B | 8.33% | 4C | 2.0 ml | 7.09% |
| 4F | 2.1 ml | 7.45% | 4G | 7.45% | 4H | 2.0 ml | 7.09% |
| 4K | 2.1 ml | 7.45% | 4L | 7.09% | 4L | 1.7 ml | 6.03% |

EXAMPLES 5A–5K

Objective: To determine if powder is stable at different concentration of chlorine 35.8% $Na_2CO_3$
19.0% STPP
6.0% S-126
4.0% STEOL 1460
4.0% NII 412-7
0.2% CGS-X
13.0% Magnesol
28.0% did not add Examples 5A to 5E
1.8 Enforcer
8.2 g. powder
Examples 5F to 5J
1.6 g ACD
8.4 g powder
Examples 5K to 50
1.1 g. CDB
8.9 g. powder

EXAMPLES 6A–6K 37.0% $Na_2CO_3$
19.0% STPP
6.0% S-12%
4.0% STEOL 1460

-continued 4.0% NII 412-7
0.2% CGS-X
18.0% did not add
7.0% Sipernat 50
4.8% $Na_2SO_4$ Examples 6A to 6E
1.8 Enforcer
8.2 g. powder
Examples 6F to 6J
1.6 g. ACD
8.4 g. powder
Examples 6K to 60
1.1 g. CDB
8.9 g. powder
Titration to determine active chlorine.

| Initial | | | 4 Weeks | | 6 Weeks | | |
|---|---|---|---|---|---|---|---|
| 5A | 1.7 ml | 6.03% | 5B | 6.38% | 5C | 1.7 ml | 6.03% |
| 5F | 1.8 ml | 6.38% | 5G | 7.45% | 5H | 1.6 ml | 5.67% |
| 5K | 1.8 ml | 6.38% | 5L | 6.03% | 5M | 1.3 ml | 4.61% |
| 6A | 1.8 ml | 6.38% | 6B | 6.38% | 6C | 1.8 ml | 6.38% |
| 6F | 1.8 ml | 6.38% | 6G | 7.09% | 6H | 1.8 ml | 6.38% |
| 6K | 1.6 ml | 5.67% | 6L | 5.60% | 6M | 1.4 ml | 4.96% |

EXAMPLE 7A–7K 33.0% $Na_2CO_3$
19.0% STPP
5.8% S-126
6.0% Dodecylbenzene sulfonic acid $C_{12-16}$
4.0% STEOL 1460
4.0% NII 1412-7
0.2% Tinopal CBS-X
6.0% Sipernat 50
22.0% Enforcer RC

DETAILED DESCRIPTION OF DRAWINGS

FIG. 1 is a bar graph showing that the available chlorine in the compositions containing encapsulated chlorine (Enforcer RC and ACP) were substantially maintained for six weeks at elevate temperature (120° F.) while the available chlorine in the unencapsulated material was substantially depleted. The materials of Example 1 uses a magnesium silicate as a material that isolates the chlorine source from the water and organic materials.

Figure 1:
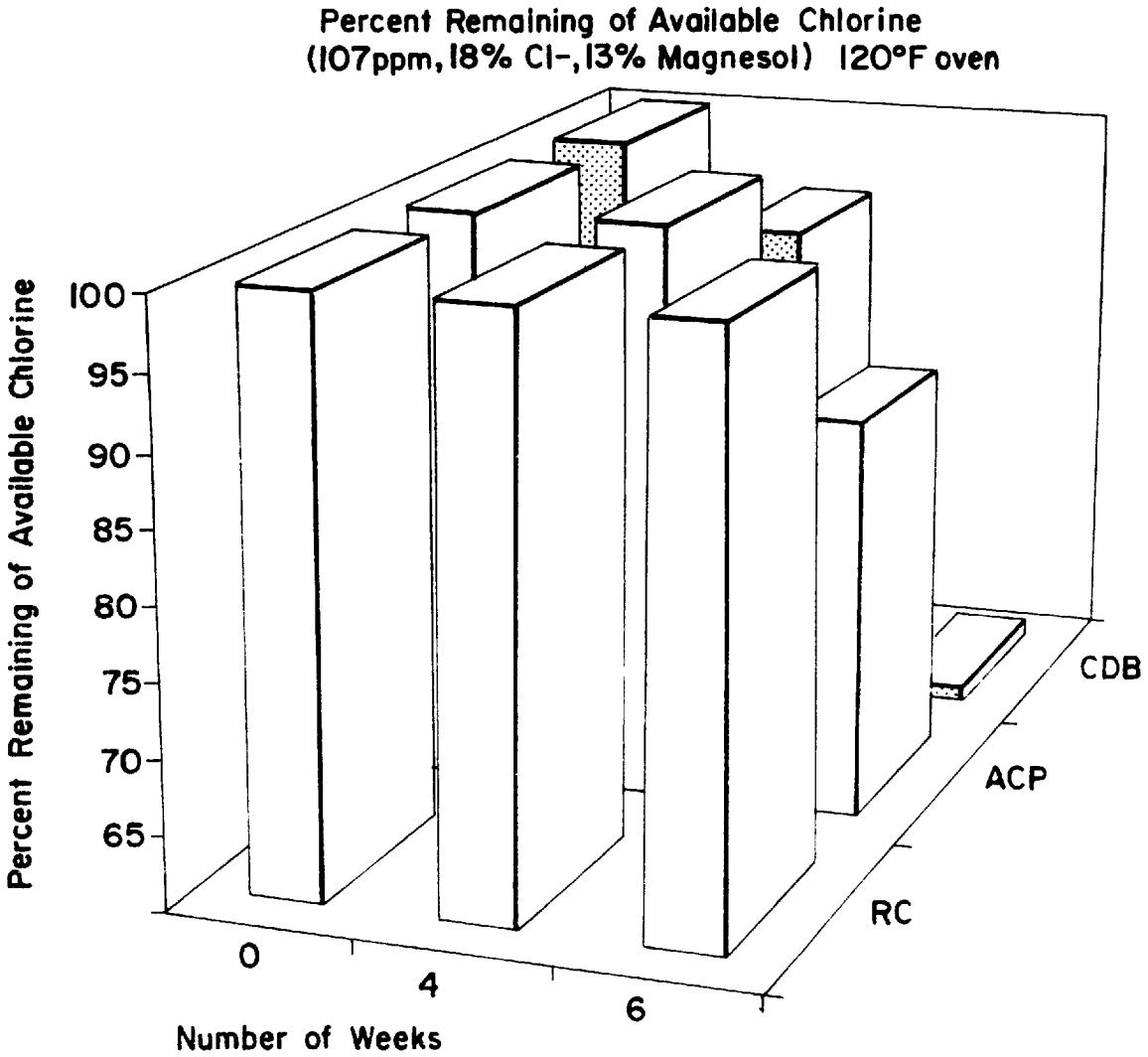
Figure 2:
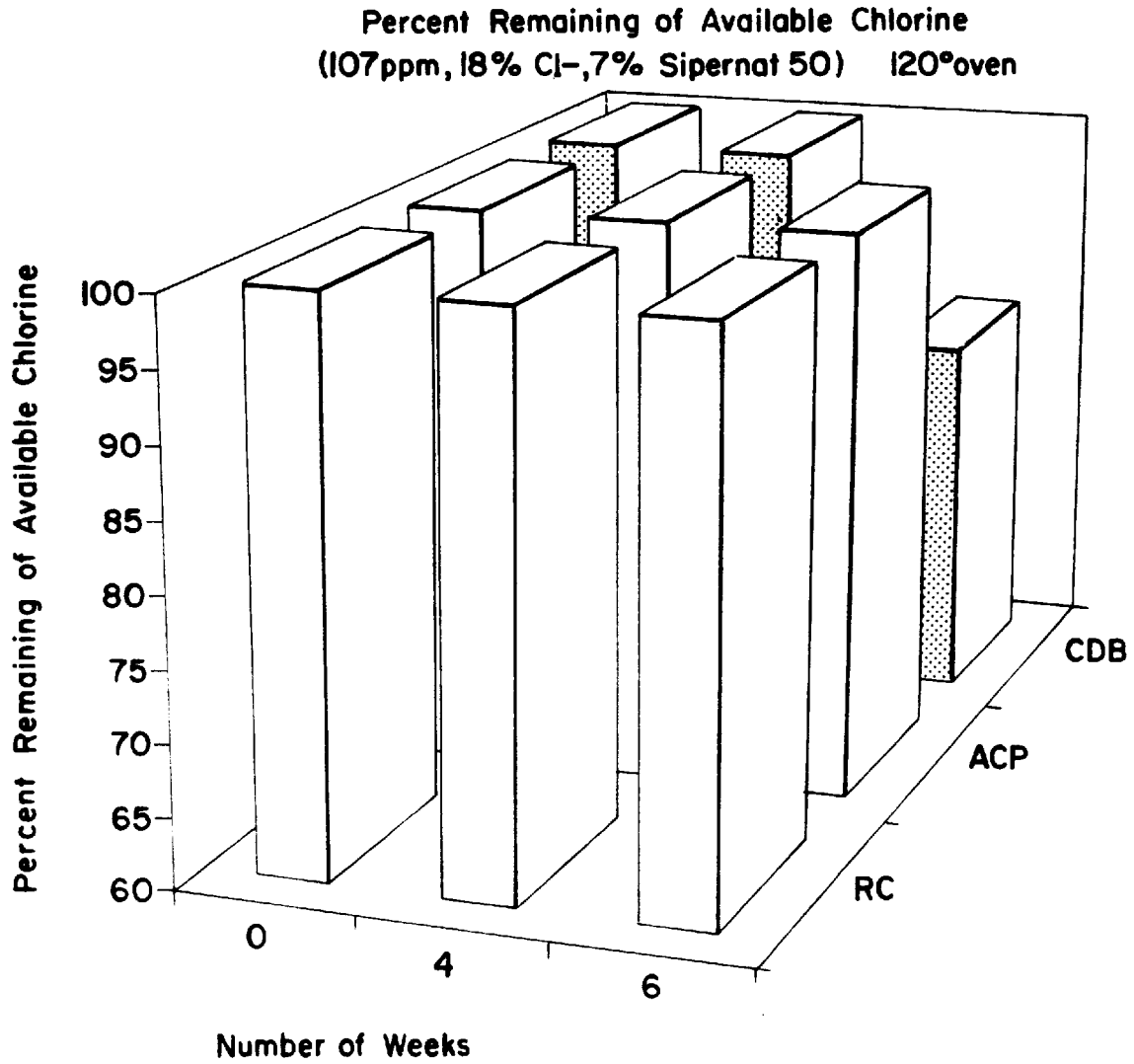
FIG. 2 is similar to claim 1 except that the silicate material is an amorphous silica (Sipernat D50). The silica is an improved material for separating chlorine from water and organics.
Figure 3:
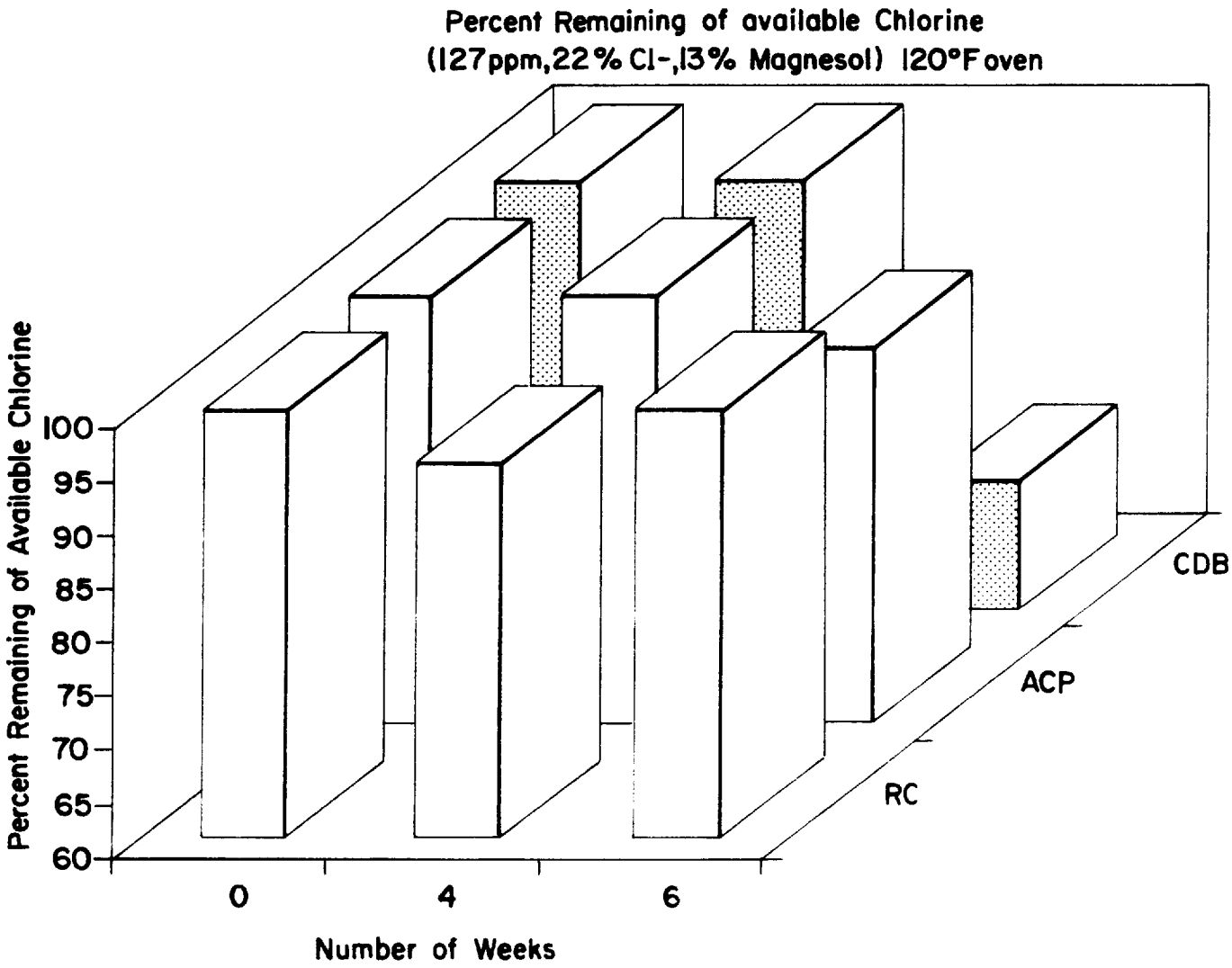
FIG. 3 is similar to FIGS. 1 and 2 except that the silicate material is a magnesium silicate.
Figure 4:
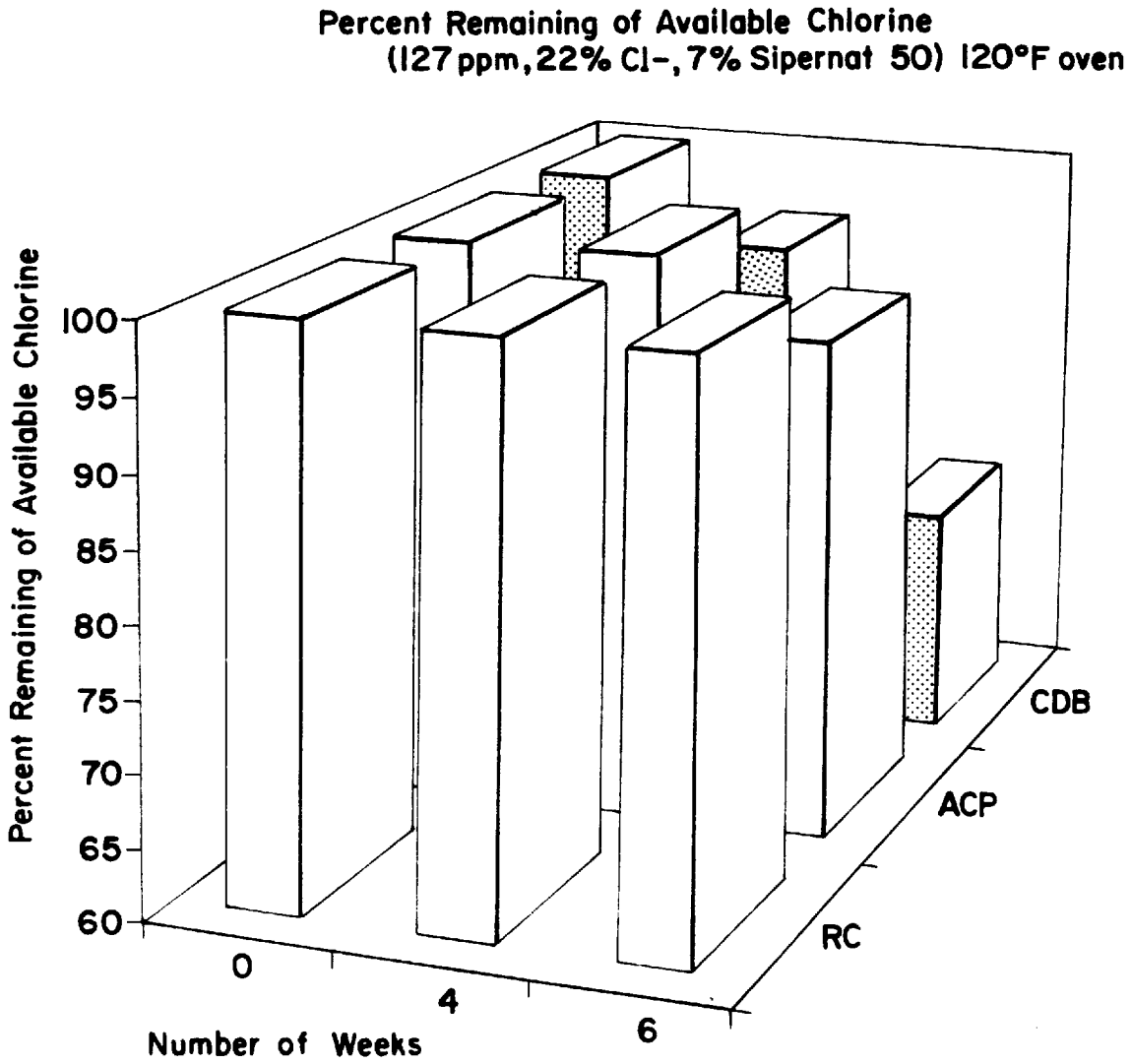
FIG. 4 is similar to FIG. 2 using Sipernat 50, an amorphous silica.

In all FIGS. 1 through 4, the samples containing the unencapsulated chlorinated isocyanurate lost substantial chlorine activity over a six week period. During the same six week period, the encapsulated chlorine sources maintained substantial activity even under the harsh 120° F. conditions.

The following table contains data shown in FIGS. 1 through 4.

| | Percent $Cl_2$ Retained | | | |
|---|---|---|---|---|
| | RC | ACP | CDB | |
| 0 | 100 | 100 | 100 | |
| 4 | 95 | 100 | 100 | −1 Magnesol/127 ppm |
| 6 | 100 | 95 | 72 | |
| 0 | 100 | 100 | 100 | |
| 4 | 100 | 100 | 95 | −2 Sip 50/127 ppm |
| 6 | 100 | 95 | 76 | |
| 0 | 100 | 100 | 100 | |
| 4 | 100 | 100 | 94 | −3 Magnesol/107 ppm |
| 6 | 100 | 87 | 61 | |
| 0 | 100 | 100 | 100 | |
| 4 | 100 | 100 | 100 | −4 Sip 50/107 ppm |
| 6 | 100 | 100 | 86 | |

The above specification, examples and data provide a complete description of the manufacture and use of the composition of the invention. Since many embodiments of the invention can be made without departing from the spirit and scope of the invention, the invention resides in the claims hereinafter appended.

We claim:

1. A stable halogen containing one pack particulate detergent composition comprising a blend of:

(a) an encapsulated halogen source; and (b) a detergent particulate comprising an internal composition and an external composition;

(i) the internal composition comprising an inorganic component comprising about 5–99.95 wt-%, based on composition of a builder salt and about 0.1–70 wt-%, based on composition of an absorbed organic surfactant component and an absorbed water component; and (ii) the internal composition dried by about 0.05–20 wt-%, based on composition, the external silicate drying compound;

wherein the external silicon drying compound separates the active halogen source from water and the organic surfactant and the particulate detergent is stable at a temperature of at least 110° F. for greater than two months.

2. The detergent of claim 1 wherein the halogen source comprises about 1 to 30 wt % of a chlorine source.

3. The detergent of claim 1 wherein the builder salt comprises sodium carbonate, sodium sulfate or mixtures thereof.

4. The detergent of claim 1 wherein the inorganic component comprises a blend of sodium carbonate and sodium tripolyphosphate.

5. The detergent of claim 1 wherein the surfactant component comprises an anionic surfactant, a nonionic surfactant or a blend thereof free of a phenol ethoxylate component.

6. The detergent of claim 5 wherein the blend of anionic and nonionic comprises a blend of an anionic sulfonate surfactant and an nonionic surfactant comprising an $(EO)_x$ group wherein x is about 1 to 100.

7. The detergent of claim 6 wherein the nonionic surfactant comprises a $C_{6-18}$ alcohol ethoxylate containing from about 2 to about 50 moles of ethylene oxide.

8. The detergent of claim 1 wherein the silicate compound comprises a magnesium silicate.

9. The detergent of claim 8 wherein the magnesium silicate comprises $MgO:SiO_2$ wherein there is about one part by weight of magnesium oxide per each 2 to 3 parts of silicone dioxide.

10. The detergent of claim 1 wherein the internal composition comprises about 0.01 to 10 wt % water.

11. The detergent of claim 1 wherein the silicate compound comprises an amorphous silica.

12. A process for the manufacture of a stable halogen containing one part particulate detergent composition, the process steps comprising:

(a) absorbing at least one organic surfactant, about 0.1–70 wt-%, based on composition, on an inorganic particulate, about 5–99.95 wt-%, based on composition, to form a surfactant absorbed particulate;

(b) blending the surfactant absorbed particulate with about 0.05–20 wt-%, based on composition of a silicate drying agent to form a dried surfactant absorbed particulate; and (c) combining the dried surfactant absorbed particulate with an encapsulated chlorine source;

wherein the silicate drying agent separates the halogen source from water and the organic surfactant contained within the particulate and the detergent is stable at a temperature of at least 110° F. for greater than about two months.

13. The process of claim 12 wherein the inorganic particulate comprises a builder salt.

14. The process of claim 13 wherein the builder salt comprises sodium carbonate, sodium sulfate or mixtures thereof.

15. The process of claim 13 wherein the builder salt additionally comprises sodium tripolyphosphate.

16. The process of claim 12 wherein the organic surfactant comprises an anionic surfactant, a nonionic surfactant or mixtures thereof free of phenol ethoxylate.

17. The process of claim 12 wherein the blend of anionic and nonionic comprises a blend of an organic sulfonate and a nonionic surfactant having an $(EO)_x$ group wherein x is about 2 to about 100.

18. The process of claim 17 wherein the nonionic surfactant comprises a $C_{6-18}$ alcohol ethoxylate having 2 to 25 moles of ethylene oxide.

19. The process of claim 12 wherein the silicon drying agent comprises a magnesium silicate.

20. The process of claim 19 wherein the magnesium silicate comprises a compound of the formula $MgO:SiO_2$ wherein per each part by weight of magnesium oxide there is about 2–4 parts by weight of silicon dioxide.

21. A stable halogen containing one pack particulate detergent composition comprising a blend of:

(a) an encapsulated halogen source; and (b) a detergent particulate comprising an internal composition and an external drying compound;

(i) the internal composition comprising about 5–99.95 wt-%, based on composition of sodium carbonate and sodium tripolyphosphate and about 0.1–70 wt-%, based on composition of an absorbed organic surfactant component comprising an alkyl benzene sulfonate, an alcohol ethoxylate and a $C_{6-18}$ linear alcohol ethoxylate sulfate and an absorbed water component; and (ii) the internal composition dried by about 0.05–20 wt-%, based on composition of the external silicate drying compound;

wherein the external silicon drying compound separates the active halogen source from water and the organic surfactant and the particulate detergent is stable at a temperature of at least 110° F. for greater than two months.

22. The detergent of claim 21 wherein the encapsulate halogen source comprises about 1 to 30 wt % of a chlorine source.

23. The detergent composition of claim 21 wherein the alcohol ethoxylate comprises a surfactant comprising an $(EO)_x$ group wherein x is about 1 to 100.

24. The detergent composition of claim 21 wherein the alcohol ethoxylate comprises a $C_{6-18}$ alcohol ethoxylate containing from about 2 to about 50 moles of ethylene oxide.

25. The detergent composition of claim 21 wherein the silicate compound comprises a magnesium silicate.

26. The detergent composition of claim 25 wherein the magnesium silicate comprises $MgO:SiO_2$ wherein there is about one part by weight of magnesium oxide per each 2 to 3 parts of silicone dioxide.

27. The detergent composition of claim 21 wherein the internal composition comprises about 0.1 to 10 wt % water.

28. The detergent composition of claim 21 wherein the silicate compound comprises an amorphous silica.

29. The detergent composition of claim 21 wherein the internal composition also comprises sodium sulfate.

30. The detergent composition of claim 21 wherein the internal composition also comprises an optical brightener.

31. The detergent composition of claim 21 wherein the detergent comprises about 15 to 25 wt % encapsulated halogen source and about 75 to 85 wt % detergent particulate.

32. A process for the manufacture of a stable halogen containing one part particulate detergent composition comprising the steps of:

(a) absorbing at least one organic anionic surfactant, about 0.1–70 wt-%, based on composition, onto an inorganic builder salt, about 5–99.95 wt-%, based on composition, to form a anionic absorbed builder salt particulate;

(b) blending the anionic absorbed builder salt particulate with about 0.05–20 wt-%, based on composition of a silicate drying agent to form a dried anionic builder salt particulate;

(c) absorbing at least one nonionic surfactant, about 0.1–70 wt-%, based on composition, onto the dried anionic builder salt particulate, about 5–99.95 wt-%, based on composition, to form an anionic-nonionic absorbed particulate;

(d) blending the anionic-nonionic builder salt particulate with about 0.05–20 wt-%, based on composition of a silicate drying agent to form a dried anionic-nonionic builder salt particulate; and (e) combining the dried anionic-nonionic builder salt particulate with an encapsulated halogen source for the particulate detergent wherein the silicate drying agent separates the halogen source from water and the organic surfactant component and the particulate detergent is stable at a temperature of at least 110° F. for greater than about two months.

33. The process of claim 32 wherein the first surfactant composition comprises an anionic sulfonate surfactant or a blend of an anionic sulfonate surfactant and a nonionic surfactant.

34. The process of claim 32 wherein the second surfactant comprises a nonionic surfactant or a blend of an anionic sulfate surfactant and a nonionic surfactant.

35. The process of claim 32 wherein the inorganic particulate comprises a builder salt.

36. The process of claim 32 wherein the builder salt comprises sodium carbonate, sodium sulfate or mixtures thereof.

37. The process of claim 32 wherein the builder salt additionally comprises sodium tripolyphosphate.

38. The process of claim 32 wherein the organic surfactant comprises an anionic surfactant, a nonionic surfactant or mixtures thereof free of phenol ethoxylate.

39. The process of claim 32 wherein the blend of anionic and nonionic comprises a blend of an organic sulfonate and a nonionic surfactant having an $(EO)_x$ group wherein x is about 2 to about 100.

40. The process of claim 32 wherein the nonionic surfactant comprises a $C_{6-18}$ alcohol ethoxylate having 2 to 25 moles of ethylene oxide.

41. The process of claim 32 wherein the silicon drying agent comprises a magnesium silicate.

42. The process of claim 32 wherein the magnesium silicate comprises a compound of the formula $MgO:SiO_2$ wherein per each part by weight of magnesium oxide there is about 2–4 parts by weight of silicon dioxide.

* * * * *